US010842253B2

(12) United States Patent
Main

(10) Patent No.: US 10,842,253 B2
(45) Date of Patent: Nov. 24, 2020

(54) ONE-PIECE UTILITY POUCH FOR FIREARM

(71) Applicant: BlackPoint Tactical, LLC, Alpharetta, GA (US)

(72) Inventor: Adam Main, Alpharetta, GA (US)

(73) Assignee: BLACKPOINT TACTICAL LLC, Alpharetta, GA (US)

( * ) Notice: Subject to any disclaimer, the term of this patent is extended or adjusted under 35 U.S.C. 154(b) by 0 days.

(21) Appl. No.: 16/675,776

(22) Filed: Nov. 6, 2019

(65) Prior Publication Data

US 2020/0138175 A1 May 7, 2020

Related U.S. Application Data

(60) Provisional application No. 62/756,332, filed on Nov. 6, 2018.

(51) Int. Cl.

| | |
|---|---|
| ***A45F 5/02*** | (2006.01) |
| ***F41C 33/02*** | (2006.01) |
| ***F42B 39/02*** | (2006.01) |

(52) U.S. Cl.

CPC ..... *A45F 5/021* (2013.01); *F42B 39/02* (2013.01); *A45F 2200/0508* (2013.01); *A45F 2200/0591* (2013.01); *F41C 33/0209* (2013.01)

(58) Field of Classification Search

CPC ..... A45F 5/021; A45F 2200/0591; A45F 2200/0508; F42B 39/02; F41C 33/02; F41C 33/0218; F41C 33/0227; F41C 33/0209; B65D 2313/00

USPC ..... 220/62

See application file for complete search history.

(56) References Cited

U.S. PATENT DOCUMENTS 3,008,617 A * 11/1961 Villwock ..... F41C 33/0209 224/183
3,379,335 A * 4/1968 Mongelluzzo ..... B65F 1/02 220/62
4,408,706 A * 10/1983 Hurley ..... B26B 29/025 224/192
4,438,859 A * 3/1984 Solek ..... H02G 3/081 220/3.2
4,496,088 A * 1/1985 Tuthill ..... A45F 5/02 224/232
4,982,885 A * 1/1991 Severson ..... A45C 13/30 224/250
5,018,653 A * 5/1991 Shoemaker ..... F41C 33/0227 224/193
5,169,025 A * 12/1992 Guo ..... B65D 81/3876 215/12.1
5,535,928 A * 7/1996 Herring ..... A45F 5/021 224/250
D376,957 S * 12/1996 Sharp ..... D7/607
(Continued)

*Primary Examiner* — Justin M Larson
(74) *Attorney, Agent, or Firm* — Eversheds Sutherland (US) LLP

(57) ABSTRACT

A utility pouch for housing an object. The utility pouch comprising a first side with two circular holes, a second side with two protrusions, a third side with two circular holes, a fourth side with two protrusions, wherein the length of the fourth side is equivalent to the length of the second side, a fifth side with two circular holes similarly aligned lengthwise as the two circular holes on the first side, wherein the length of the fifth side is the same as the length of the first side.

5 Claims, 12 Drawing Sheets

(56) References Cited

U.S. PATENT DOCUMENTS

| | | | | |
|---|---|---|---|---|
| 6,237,820 | B1 * | 5/2001 | Saxton | A45F 3/16 215/395 |
| 6,330,430 | B1 * | 12/2001 | Jensfelt | H04B 1/3888 455/575.8 |
| D493,279 | S * | 7/2004 | Tabata | D3/218 |
| 8,047,493 | B1 * | 11/2011 | Cohen | B62J 11/00 248/311.2 |
| 8,789,256 | B2 * | 7/2014 | Temblador | B21D 51/52 29/505 |
| 9,033,148 | B2 * | 5/2015 | Adams | B26B 29/025 206/349 |
| 9,668,568 | B2 * | 6/2017 | Evans | A45F 5/00 |
| 10,126,096 | B2 * | 11/2018 | Schweitzer | F41C 33/0209 |
| 10,126,097 | B2 * | 11/2018 | Schweitzer | F41C 33/0218 |
| 10,161,714 | B1 * | 12/2018 | de Nijs | F41C 33/0218 |
| 10,184,754 | B2 * | 1/2019 | Laemmlen | H04B 1/3888 |
| 10,274,295 | B2 * | 4/2019 | Peelgrane | F42B 39/02 |
| 2006/0049224 | A1 * | 3/2006 | Lin | F41C 33/045 224/198 |
| 2007/0045364 | A1 * | 3/2007 | Grundy | A45F 5/02 224/197 |
| 2015/0034684 | A1 * | 2/2015 | Tedder | A45F 5/021 224/242 |
| 2016/0066680 | A1 * | 3/2016 | Hazeltine | A45F 5/021 224/676 |
| 2016/0318200 | A1 * | 11/2016 | Wright | B26B 29/025 |
| 2017/0005686 | A1 * | 1/2017 | Borisen | H04B 1/3888 |
| 2017/0043493 | A1 * | 2/2017 | Seber | B26B 29/025 |
| 2018/0010871 | A1 * | 1/2018 | Bressler | F41A 9/24 |
| 2018/0368561 | A1 * | 12/2018 | Bond | A45F 5/00 |
| 2019/0159579 | A1 * | 5/2019 | Picking | A45F 5/021 |
| 2020/0138175 | A1 * | 5/2020 | Main | A45F 5/021 |

* cited by examiner

ONE-PIECE UTILITY POUCH FOR FIREARM

CROSS-REFERENCE TO RELATED APPLICATIONS

The disclosure claims priority to and the benefit of U.S. provisional patent application No. 62/756,332, filed Nov. 6, 2018, which is hereby incorporated by reference herein in its entirety.

FIELD OF THE DISCLOSURE

The disclosure generally relates to tactical accessories and more particularly relates to systems and methods for containing items in a utility pouch comprising of a single piece of material that is configured to be folded and attached to itself to form the utility pouch.

BACKGROUND

A wide variety of utility pouches exist that comprise a two-piece design with rivets or screws or a single piece of plastic wrapped and folded on one side and fixed on the opposite side. This requires screws to be placed parallel to the front and back of the object, which takes up excess space. What is desirable is an improved utility pouch that provides for ease of manufacturing and takes up a reduced amount of space.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

FIG. 1(*b*) is a front view of a utility pouch positioned on a magazine in accordance with one or more embodiments of the disclosure.

FIG. 1(*c*) is a rear view of a utility pouch positioned on a magazine in accordance with one or more embodiments of the disclosure.

FIG. 1(*d*) is a side view of a utility pouch positioned on a magazine in accordance with one or more embodiments of the disclosure.

FIG. 1(*e*) is a perspective view of a utility pouch positioned on a magazine in accordance with one or more embodiments of the disclosure.

FIG. 2(*b*) is a side view of a utility pouch positioned on a radio in accordance with one or more embodiments of the disclosure.

FIG. 2(*c*) is a side view of a utility pouch positioned on a radio in accordance with one or more embodiments of the disclosure.

FIG. 4(*b*) is a top view of a print for an unraveled utility pouch before it is formed in accordance with one or more embodiments of the disclosure.

FIG. 4(*c*) is a top view of an external surface of an unraveled utility pouch in accordance with one or more embodiments of the disclosure.

FIG. 4(*d*) is a front view of a utility pouch positioned on a radio and a utility pouch before it is secured with screws in accordance with one or more embodiments of the disclosure.

FIG. 4(*e*) is a side view of a utility pouch positioned on a radio and an assembled utility pouch in accordance with one or more embodiments of the disclosure.

FIG. 4(*f*) is a side view of a utility pouch positioned on a radio and an assembled utility pouch in accordance with one or more embodiments of the disclosure.

DETAILED DESCRIPTION

Figure 1A:
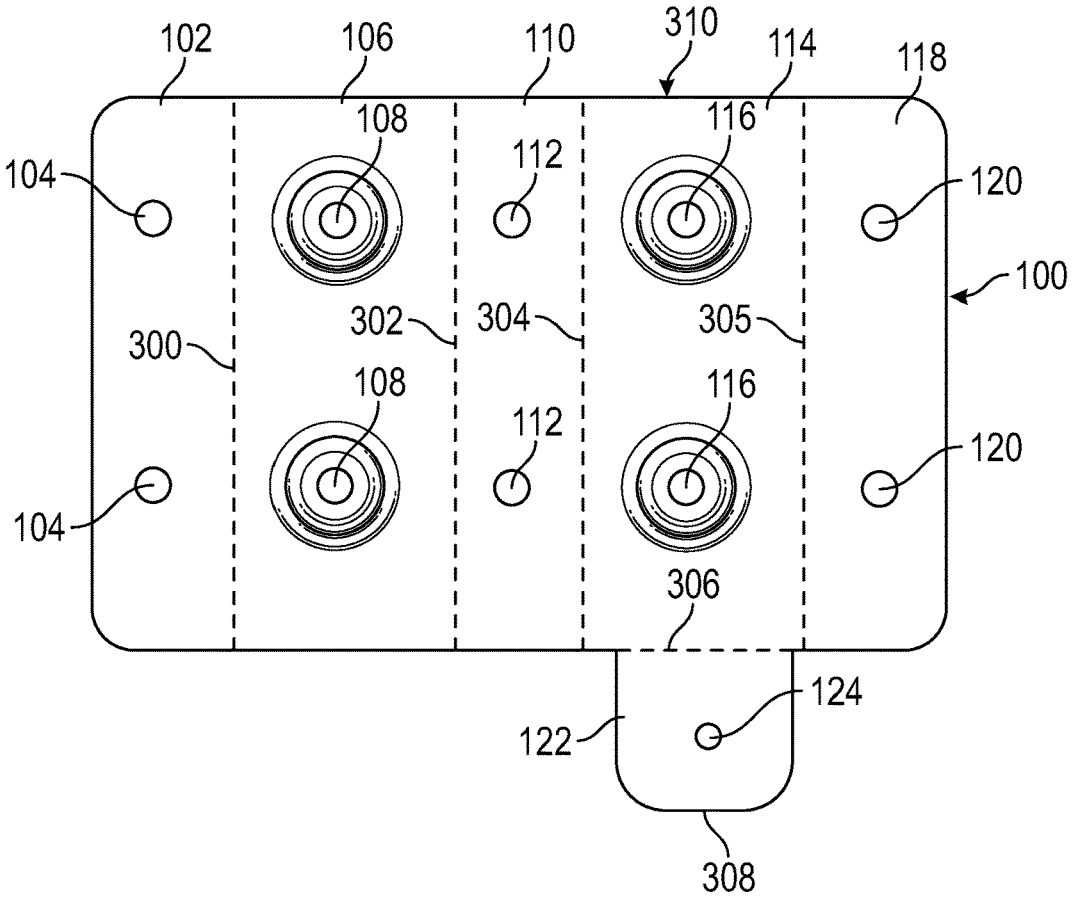
FIG. 1(*a*) is a top view of an external surface of an unraveled utility pouch in accordance with one or more embodiments of the disclosure.
Figure 1B:
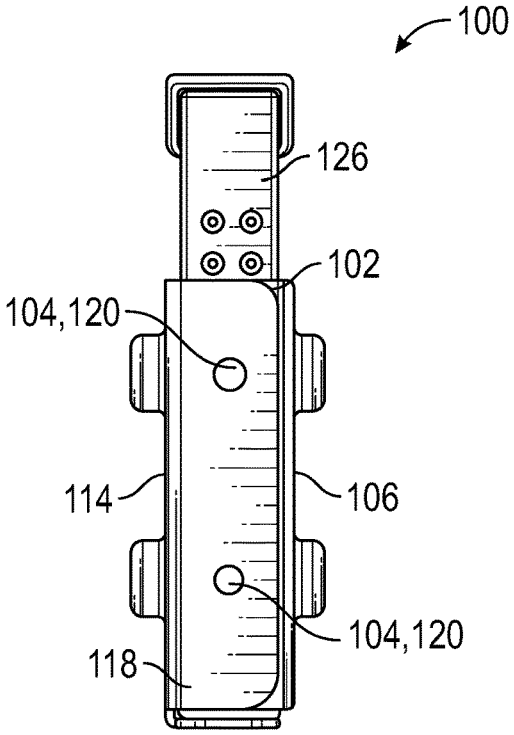
Figure 1C:
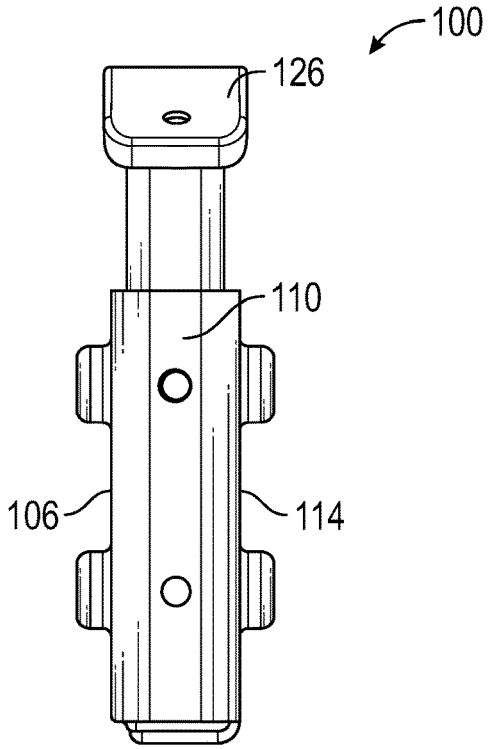
Figure 1D:
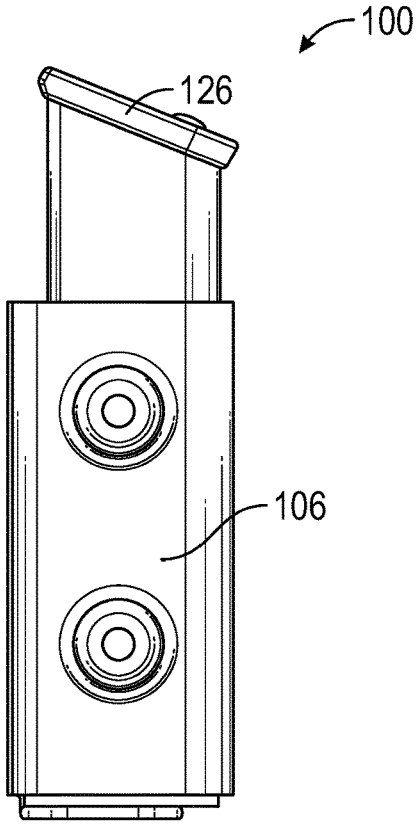
Figure 1E:
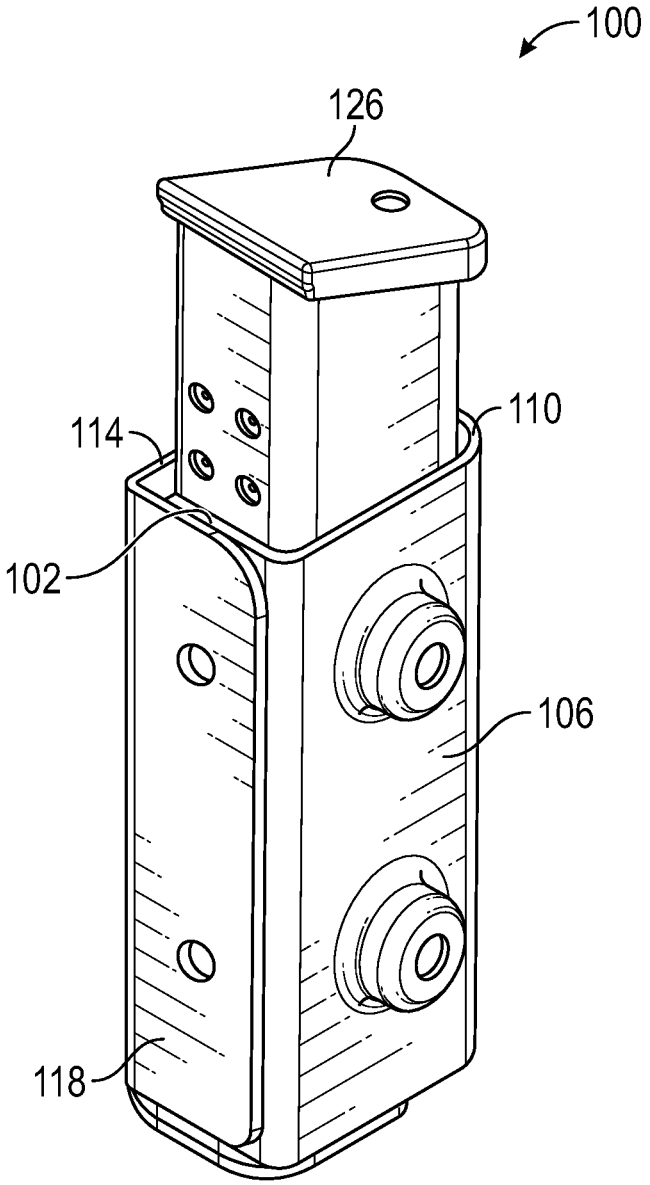

Described below are embodiments of a utility pouch comprising a single piece of material that is configured to be folded and attached to itself to form the utility pouch. Methods of manufacturing and using the utility pouch are also disclosed.

FIGS. 1(*a*) to 1(*e*) depict a utility pouch 100. The utility pouch 100 includes a first side 102 comprising two circular holes 104, a second side 106 comprising two protrusions 108 (which include apertures therein), a third side 110 comprising two circular holes 112, a fourth side 114 comprising two protrusions 116 (which include apertures therein), and a fifth side 118 comprising two circular holes 120. In some instances, the first side 102, the second side 106, the third side 110, the fourth side 114, and the fifth side 118 are generally rectangular. In other instances, they may be generally square or any other suitable size, shape, or configuration.

In certain embodiments, a bottom side 122 comprising a circular hole 124 is attached to the fourth side 114. The utility pouch 100 comprises a single piece of material that is folded about one or more fold lines to form an internal cavity for housing an object, such as a magazine, radio, or the like. Any object may be housed in the assembled utility pouch 100.

In certain embodiments, the utility pouch 100 comprises a first fold line 300 between the first side 102 and the second side 106, a second fold line 302 between the second side 106 and the third side 110, a third fold line 304 between the third side 110 and the fourth side 114, and a fourth fold line 305 between the fourth side 114 and the fifth side 118. The utility pouch 100 also include a fifth fold line between the bottom side 122 and the fourth side 114. In this manner, when the utility pouch is assembled (e.g., folded about the fold lines), the first side 102 and the fifth side 118 overlap such that the two circular holes 104 align with the two circular holes 120, and the second side 106 and the fourth side 114 face each other in opposite directions. In this manner, the overlapped first side 102 and fifth side 118 collectively form a wall of the utility pouch 100, as depicted in FIG. 1(*b*). The bottom side 122 may be folded about the fold line 306 such that edge 308 is disposed adjacent to and/or abuts edge 310 of the fourth side 114.

Figure 2A:
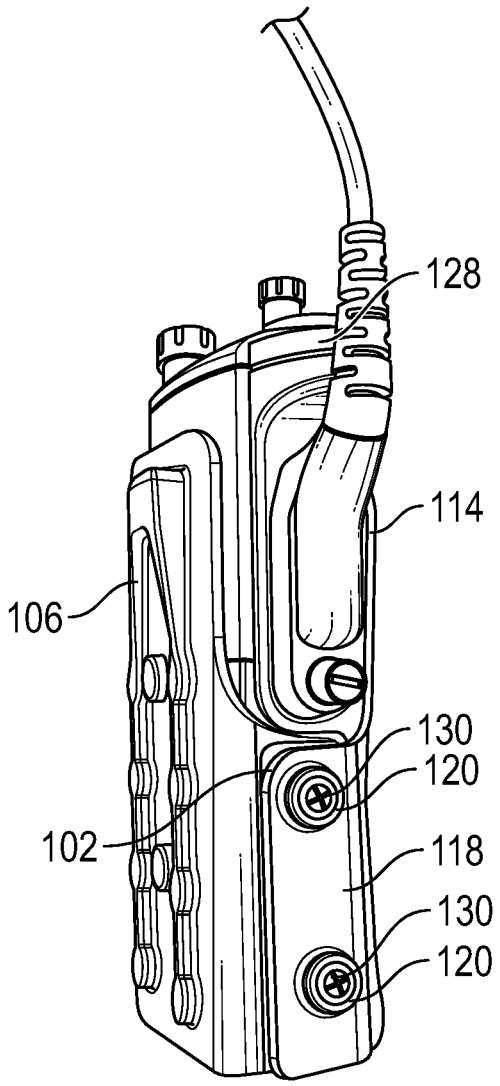
FIG. 2(*a*) is a front perspective view of a utility pouch positioned on a radio in accordance with one or more embodiments of the disclosure.
Figure 2B:
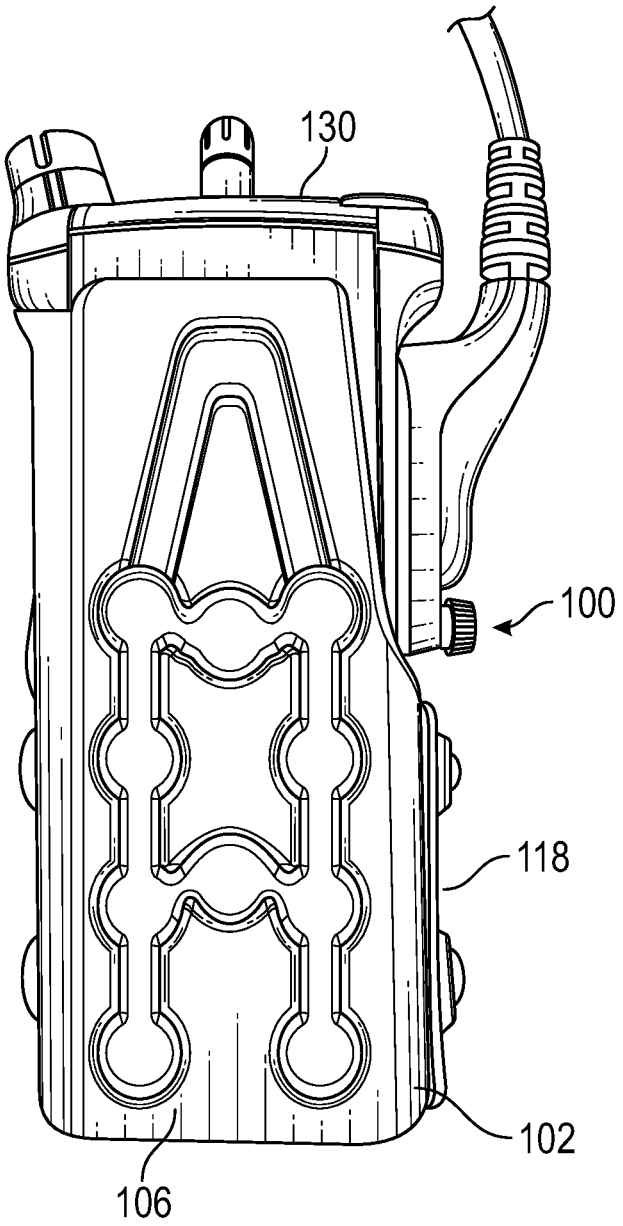
Figure 2C:
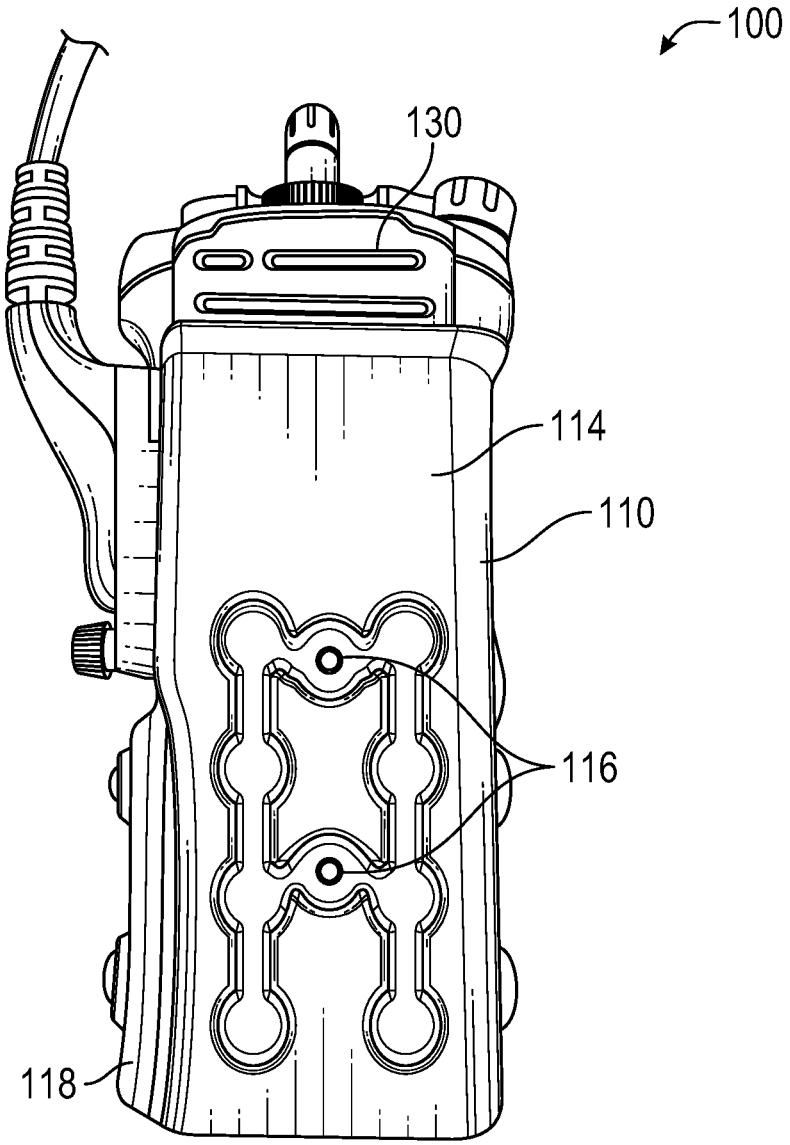

FIGS. 2(*a*) to 2(*c*) depict a utility pouch 100 being used to contain a radio 128. The utility pouch 100 may be used to contain, carry, or transport any suitable component. In certain embodiment, the first side 102 and the fifth side 118 overlap as the utility pouch 100 is assembled. The first side 102 and the fifth side 118 are shorter in length than the second side 106 and the fourth side 114. Screws are disposed within the circular holes 120 in order to ensure that the fifth side 118 remains attached to the first side 102 when the utility pouch 100 is assembled.

In some instances, as depicted in FIG. 2(*b*), the second side 106 of the utility pouch 100 may not contain any circular protrusions or holes. However, in some instances, the fourth side 114 may include circular protrusions 116 containing holes that are not similarly aligned lengthwise as the circular holes 104 and 120 on the first side 102 and the fifth side 118 respectively.

Figure 3:
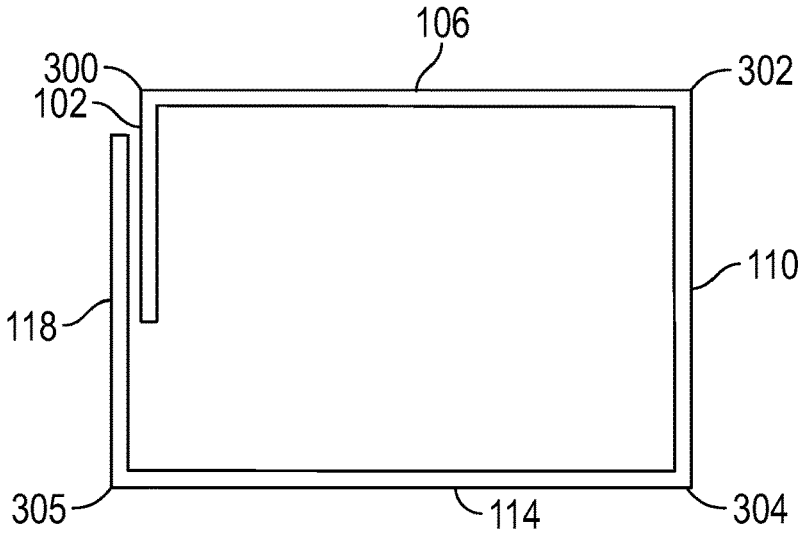
FIG. 3 is a schematic top view of a utility pouch in accordance with one or more embodiments of the disclosure.
Figure 4A:
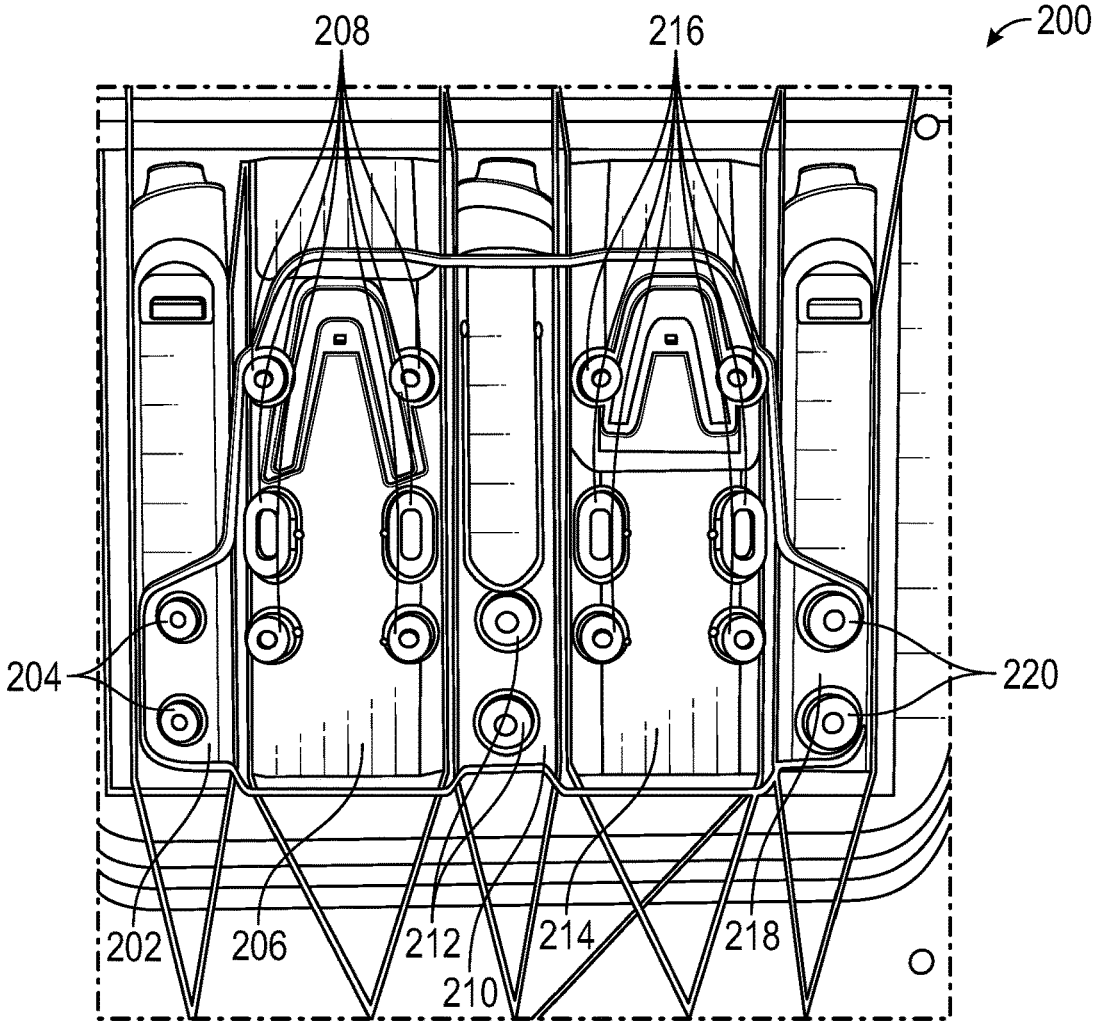
FIG. 4(*a*) is a top view of a mold for an unraveled utility pouch in accordance with one or more embodiments of the disclosure.
Figure 4B:
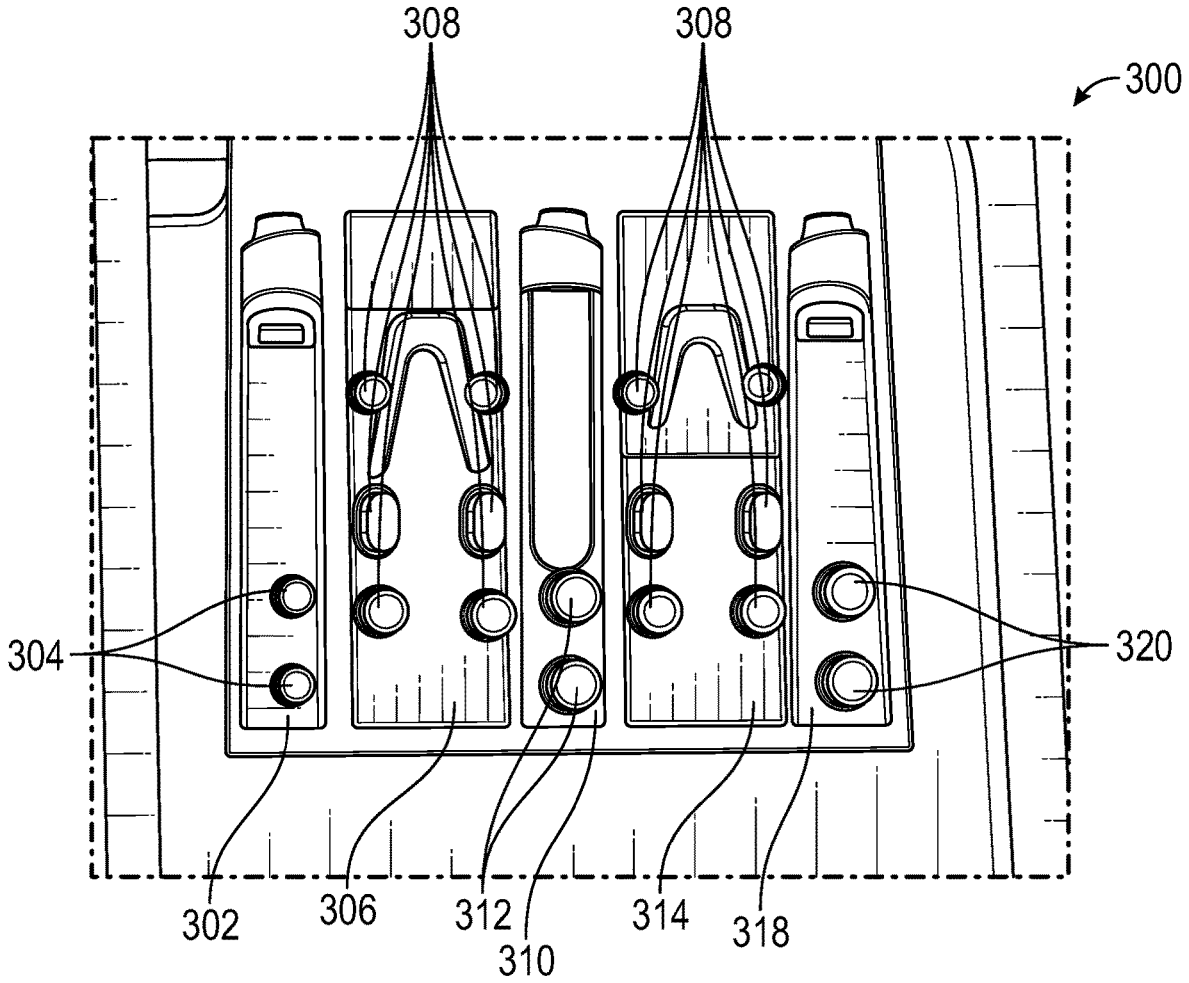
Figure 4C:
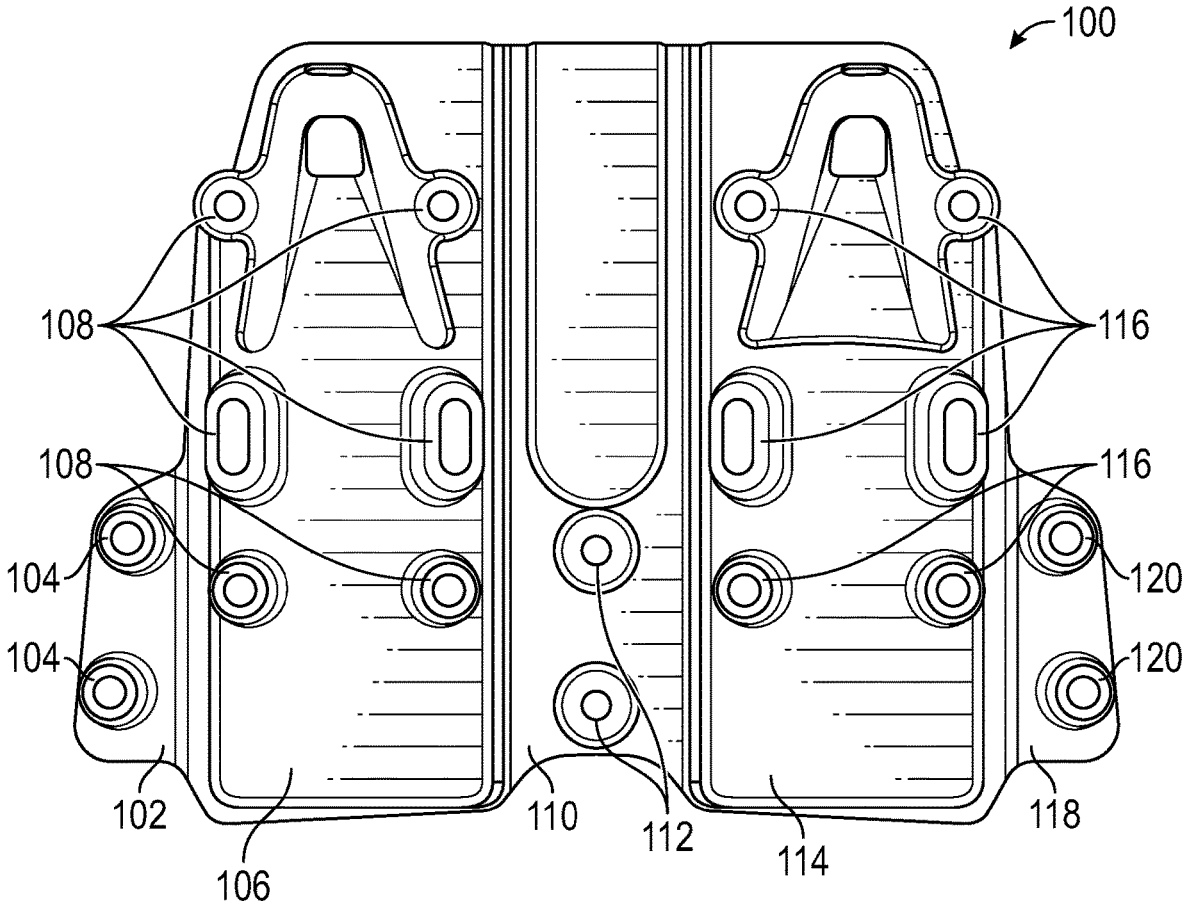
Figure 4D:
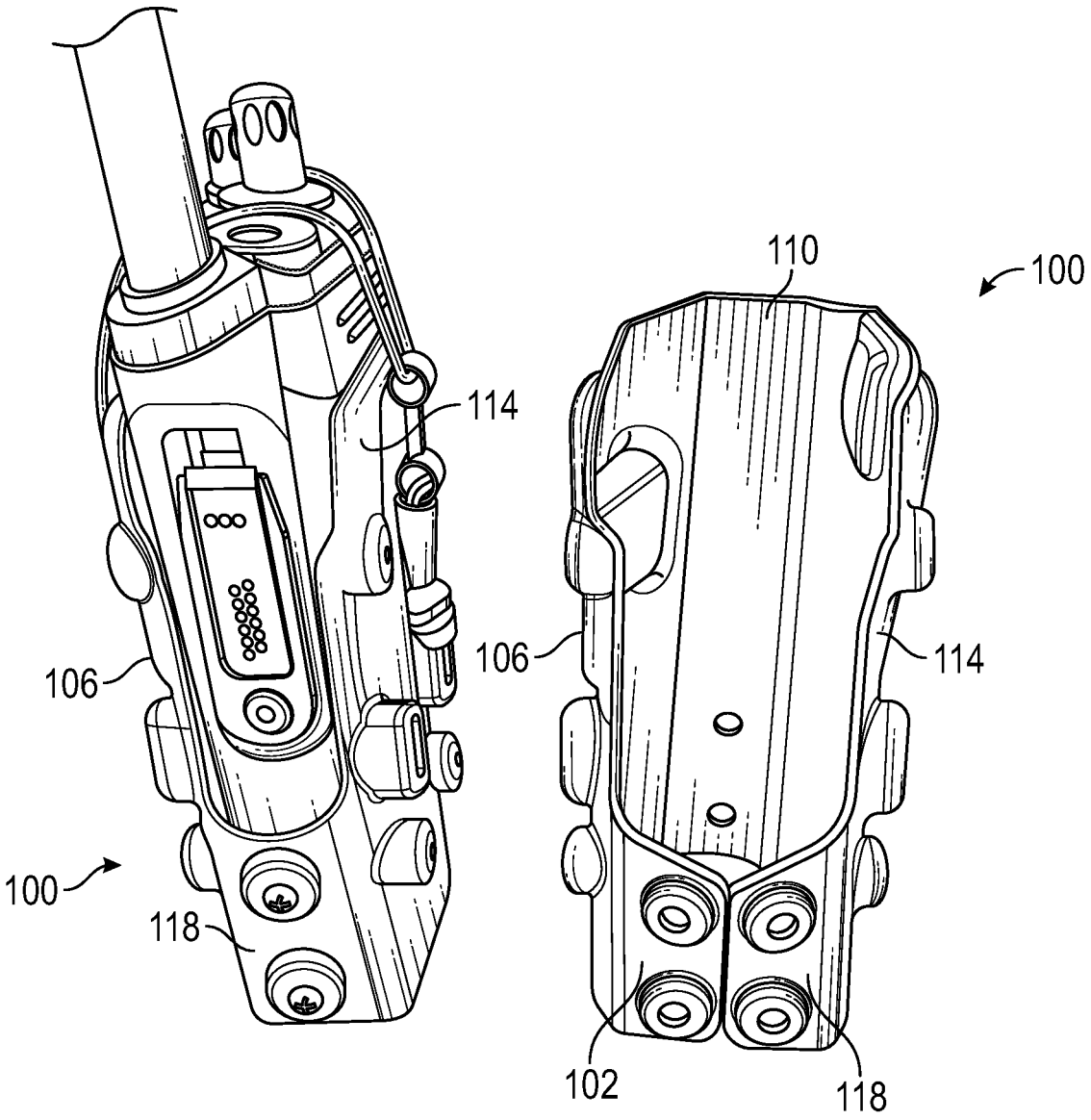
Figure 4E:
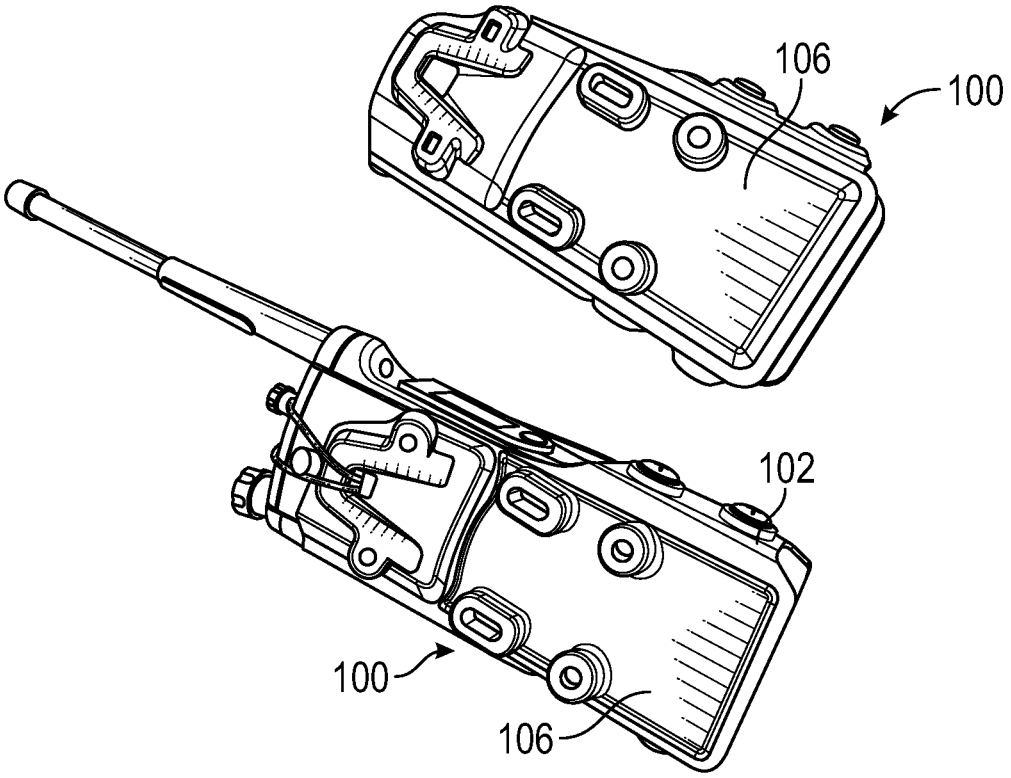
Figure 4F:
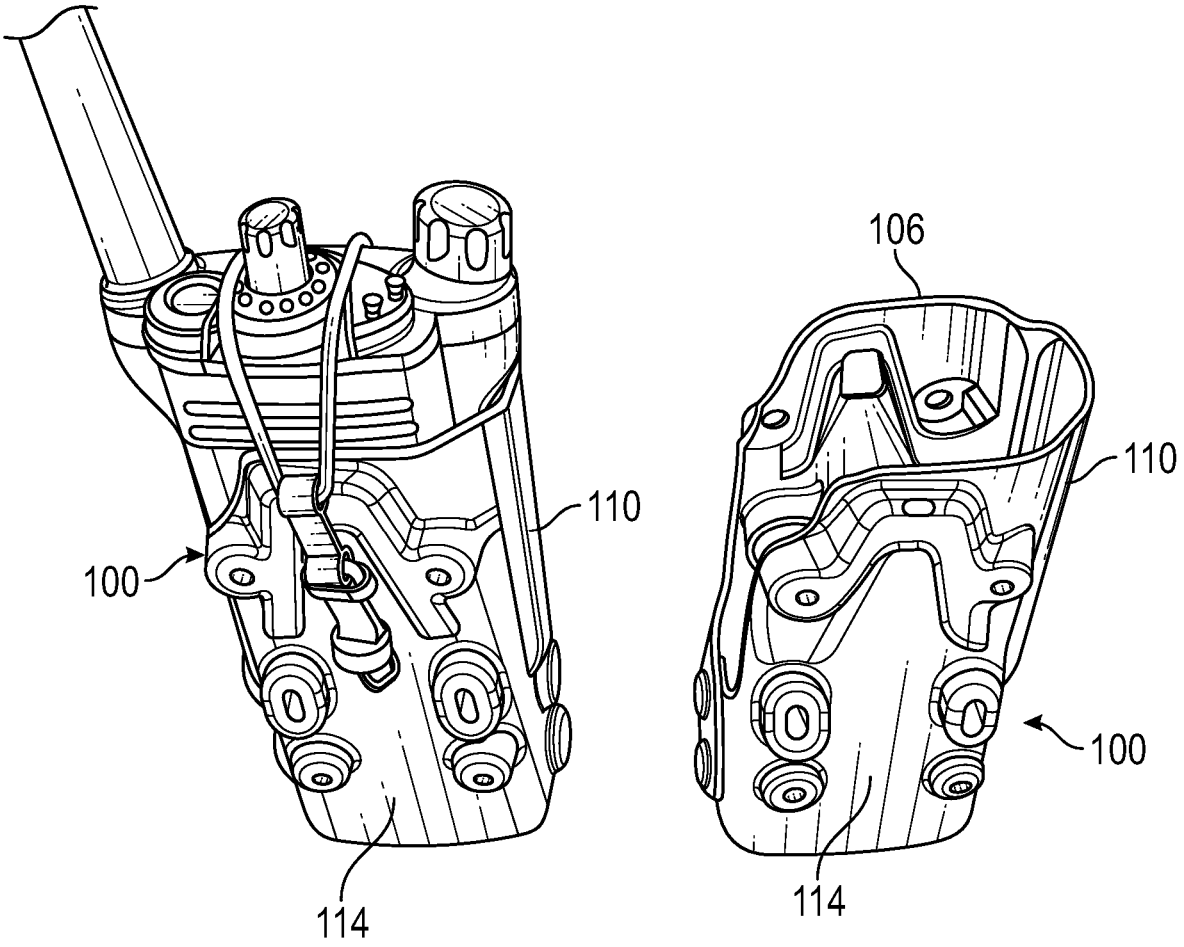

FIG. 3 depicts the assembly of the utility pouch 100. The first side 102 is angled such that it is perpendicular to the second side 106. The third side 110 is angled such that it is parallel to the first side 102, and the fourth side 114 is angled such that it is parallel to the second side 106. The fifth side 118 is angled such that it is perpendicular to the fourth side 114 and overlaps the first side 102.

FIG. 4(*a*) depicts the mold 200 for the utility pouch 100 as a single piece of material. The leftmost panel of the mold 202 corresponds to the first side 102, the second panel of the mold from the left 206 corresponds to the second side 106, the middle panel of the mold 210 corresponds to the third side 110, the second panel of the mold from the right 214 corresponds to the fourth side 114, and the rightmost panel of the mold 218 corresponds to the fifth side 118. In this embodiment, the leftmost and rightmost panels 202 and 218 respectively ensure that the first side 102 and fifth side 118 are shorter in height than the second side 106 and the fourth side 114, but are both still of the same length as each other. The circular holes 204, 212, and 220 in mold panels 202, 210, and 218 respectively ensure that the first side 102, third side 110, and fifth side 118 all contain two circular holes 104, 112, and 120 respectively. In this embodiment, the second panel 206 and fourth panel 214 ensure that the second side 106 and fourth side 114 each comprise six protrusions. Each side 106 and 114 may contain two columns of three protrusions, which may be circular or oval in shape. The protrusions 108 and 116 each contain a central hole, wherein the shape of the hole corresponds to the shape of the protrusion.

FIG. 4(*b*) depicts a print 300 of the utility pouch 100 when it is first formed. The print 300 has a clearly defined first segment 302, second segment 306, third segment 310, fourth segment 314, and fifth segment 318. The first segment 302, third segment 310 and fifth segment 318 each contain protrusions 304, 312, and 320 respectively where holes 104, 112, and 120 may be located. The second segment 306 and fourth segment 314 each contain protrusions 308 and 316 respectively. The protrusions 308 and 316 are arranged in two columns on each length of the segment. In some instances, the protrusions 304 may be configured to nest within the protrusions 320 when the utility pouch is folded about the fold lines in the assembled configuration. In some instances, the protrusions 304 may be press fit into the protrusions 320 to secure the utility pouch together. In other instances, as depicted in FIG. 4(*c*), the protrusions 304 and 320 may include apertures (e.g., holes 104 and 120) therethrough, in which a fastener, such as a screw, rivet, etc., may be positioned in order to secure the utility pouch together in the assembled position.

In some embodiments, as depicted in FIG. 4(*c*), the lengths of the first side 102 and fifth side 118 are the same, while the second side 106, third side 110, and fourth side 114 are of longer equal lengths. In some embodiments, as depicted in FIG. 4(*c*), the second side 106 and fourth side 114 may contain more than two protrusions, and thus, more than two holes, wherein the holes are arranged in two columns on the side. FIGS. 4(*d*)-(*f*) depicts the utility pouch in the assembled position with a radio positioned therein. The one-piece design of the utility pouch simplifies manufacturing and assembly.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A utility pouch for positioning an object, the utility pouch comprising:

a first side with two circular holes;

a second side with two protrusions;

a third side with two circular holes;

a fourth side with two protrusions, wherein the length of the fourth side is equivalent to the length of the second side; and a fifth side with two circular holes similarly aligned lengthwise as the two circular holes on the first side, wherein the length of the fifth side is the same as the length of the first side, wherein the utility pouch comprises a single piece of material.

2. The utility pouch of claim 1, wherein the first side and the fifth side overlap when the utility pouch is assembled.

3. The utility pouch of claim 1, wherein a screw is inserted through the circular holes of the first and fifth sides to secure the utility pouch together when it is assembled.

4. The utility pouch of claim 1, wherein the second side and the fourth side each contain more than two protrusions, each containing a central hole of the same shape as the protrusion, wherein the holes are arranged in two columns.

5. The utility pouch of claim 1, wherein the protrusions on the second side or the fourth side are attached to a belt, and wherein a screw is inserted through the central hole in the protrusion and attached to a post on the belt to hold the utility pouch in place.

* * * * *